US009500395B2

(12) United States Patent
Scheumann et al.

(10) Patent No.: US 9,500,395 B2
(45) Date of Patent: Nov. 22, 2016

(54) REFRIGERATION CIRCUIT, GAS-LIQUID SEPARATOR AND HEATING AND COOLING SYSTEM

(75) Inventors: Christian Scheumann, Frankfurt (DE); Sascha Hellmann, Rheinland-Pfalz (DE)

(73) Assignee: CARRIER CORPORATION, Farmington, CT (US)

( * ) Notice: Subject to any disclaimer, the term of this patent is extended or adjusted under 35 U.S.C. 154(b) by 332 days.

(21) Appl. No.: 14/130,759

(22) PCT Filed: Jul. 5, 2011

(86) PCT No.: PCT/EP2011/061310
§ 371 (c)(1),
(2), (4) Date: Jan. 3, 2014

(87) PCT Pub. No.: WO2013/004298
PCT Pub. Date: Jan. 10, 2013

(65) Prior Publication Data
US 2014/0130534 A1 May 15, 2014

(51) Int. Cl.
*F25B 43/00* (2006.01)
*F25B 29/00* (2006.01)
(Continued)

(52) U.S. Cl.
CPC ..... *F25B 29/003* (2013.01); *F25B 6/02* (2013.01); *F25B 41/04* (2013.01); *F25B 7/00* (2013.01); *F25B 40/04* (2013.01); *F25B 2400/0403* (2013.01); *F25B 2400/16* (2013.01); *F25B 2400/23* (2013.01)

(58) Field of Classification Search
CPC .... F25B 43/006; F25B 2400/03; F25B 1/10; F25B 13/00; F25B 25/005
USPC ..... 62/118, 291, 498, 512, 503
See application file for complete search history.

(56) References Cited

U.S. PATENT DOCUMENTS 4,238,933 A 12/1980 Coombs
4,510,762 A 4/1985 Richarts
(Continued)

FOREIGN PATENT DOCUMENTS

CH 697593 B1 12/2008
CN 101514855 A 8/2009
(Continued)

OTHER PUBLICATIONS

International Preliminary Report on Patetability for application PCT/EP2011/061310, Jan. 7, 2014, 12 pages.
International Search Report for application PCT/EP2011/061310, Nov. 6, 2012, 5 pages.

*Primary Examiner* — Melvin Jones
(74) *Attorney, Agent, or Firm* — Cantor Colburn LLP

(57) ABSTRACT

A refrigeration circuit is disclosed circulating a refrigerant and comprising in the direction of flow of the refrigerant a compressor (2); at least one condenser (14, 16) for rejecting heat to ambient air; an expansion device (8); and an evaporator (10). The refrigeration circuit further comprises a collecting container (12), the output of which being connected to the expansion device (8); a heat rejecting heat exchanger (4) for heat exchange of the refrigerant to a heat pump system, the output of the heat rejecting heat exchanger (4) being connected to the collecting container (12); and means (V1, V2) for connecting the heat rejecting heat exchanger (4) or at least one of the condenser(s) (14, 16) to the output of the compressor (2) depending on the availability of cooling power at the heat rejecting heat exchanger (4).

22 Claims, 2 Drawing Sheets

(51) Int. Cl.

| | |
|---|---|
| ***F25B 6/02*** | (2006.01) |
| ***F25B 41/04*** | (2006.01) |
| *F25B 7/00* | (2006.01) |
| *F25B 40/04* | (2006.01) |

(56) References Cited

U.S. PATENT DOCUMENTS

| | | | | |
|---|---|---|---|---|
| 5,235,820 | A | 8/1993 | Radermacher et al. | |
| 5,906,104 | A | 5/1999 | Schwartz et al. | |
| 7,216,698 | B2 | 5/2007 | Catzel | |
| 2008/0307805 | A1* | 12/2008 | Gupte | F25B 1/10 62/117 |
| 2009/0320504 | A1* | 12/2009 | Gupte | F25B 39/02 62/81 |
| 2011/0056227 | A1 | 3/2011 | Jung | |

FOREIGN PATENT DOCUMENTS

| | | | |
|---|---|---|---|
| CN | 101769580 | A | 7/2010 |
| CN | 201652663 | U | 11/2010 |
| CN | 101900448 | A | 12/2010 |
| DE | 3030754 | A1 | 2/1982 |
| DE | 10322674 | A1 | 12/2004 |
| DE | 202004018208 | U1 | 1/2005 |
| JP | 403001056 | A | 1/1991 |
| JP | 2006170589 | A | 6/2006 |
| KR | 99073128 | A | 10/1999 |
| KR | 2000032459 | A | 6/2000 |
| TW | 290221 | U | 5/2006 |
| WO | 2007055386 | A1 | 6/2006 |
| WO | 2006083329 | A2 | 8/2006 |
| WO | 2006095310 | A2 | 9/2006 |

* cited by examiner

REFRIGERATION CIRCUIT, GAS-LIQUID SEPARATOR AND HEATING AND COOLING SYSTEM

The present invention relates to a refrigeration circuit, a gas-liquid-separator and a heating and cooling system comprising such refrigeration circuit.

Refrigeration circuits circulating a refrigerant and comprising in the direction of the flow of the refrigerant a compressor, a heat rejecting heat exchanger working as a condenser, an expansion device and an evaporator, have been known for a long time.

Heat can be dissipated to ambient air or can be used for heating a heat system, particularly a heat pump system. A refrigeration circuit can be coupled to a heat pump system by means of the condenser of the refrigeration circuit which forms at the same time the evaporator of the heat pump system. A refrigeration circuit coupled to a heat pump system in that way is efficient, since the heat generated by the condenser is not wasted, but rather utilized by the heat pump system. However, in such refrigeration circuit coupled to a heat pump system, problems arise, when the heat dissipated differs from the heat needed to operate the refrigeration circuit and to obtain the desired cooling at the evaporator(s) of the refrigeration circuit.

It therefore would be beneficial to provide a refrigeration circuit which allows for an efficient operation and to obtain the desired cooling at the evaporators, no matter how much the heat demand at the side of the heat rejecting heat exchanger is.

Exemplary embodiments of the invention include a refrigeration circuit circulating a refrigerant and comprising in the direction of flow of the refrigerant a compressor; at least one condenser for rejecting heat to ambient air; an expansion device; and an evaporator; the refrigeration circuit further comprising a collecting container, the output of which being connected to the expansion device; a heat rejecting heat exchanger for heat exchange of the refrigerant to a heat pump system, the output of the heat rejecting heat exchanger being connected to the collecting container; and means for connecting the heat rejecting heat exchanger or at least one of the condenser(s) to the output of the compressor depending on the availability of cooling power at the heat rejecting heat exchanger.

Exemplary embodiments of the invention further include a gas-liquid-separator, especially for use in a refrigeration circuit as described herein, connected to a line in which refrigerant comprising a gaseous phase and a liquid phase flows, and comprising a broadened line portion to be connected to the line in which refrigerant comprising a gaseous phase and a liquid phase flows, wherein the velocity of flow of the refrigerant is reduced in the broadened line portion, such that the liquid phase refrigerant flows at the bottom and the gaseous phase refrigerant flows above the liquid phase refrigerant; and a T-branch, with the first branch of the T-branch to be connected to a gaseous refrigerant output line and the second branch of the T-branch to be connected to a liquid refrigerant output line.

Exemplary embodiments of the invention further include a heating and cooling system comprising a refrigeration circuit as described herein; and a heat-pump system; wherein the first heat rejecting heat exchanger of the refrigeration circuit is configured to serve as a heat source in the heat pump system.

Exemplary embodiments of the invention will be described in more detail with reference to the enclosed figures, wherein:

FIG. 1 shows a schematic view of a exemplary refrigeration circuit 1 according to an embodiment of the invention.

Figure 1:
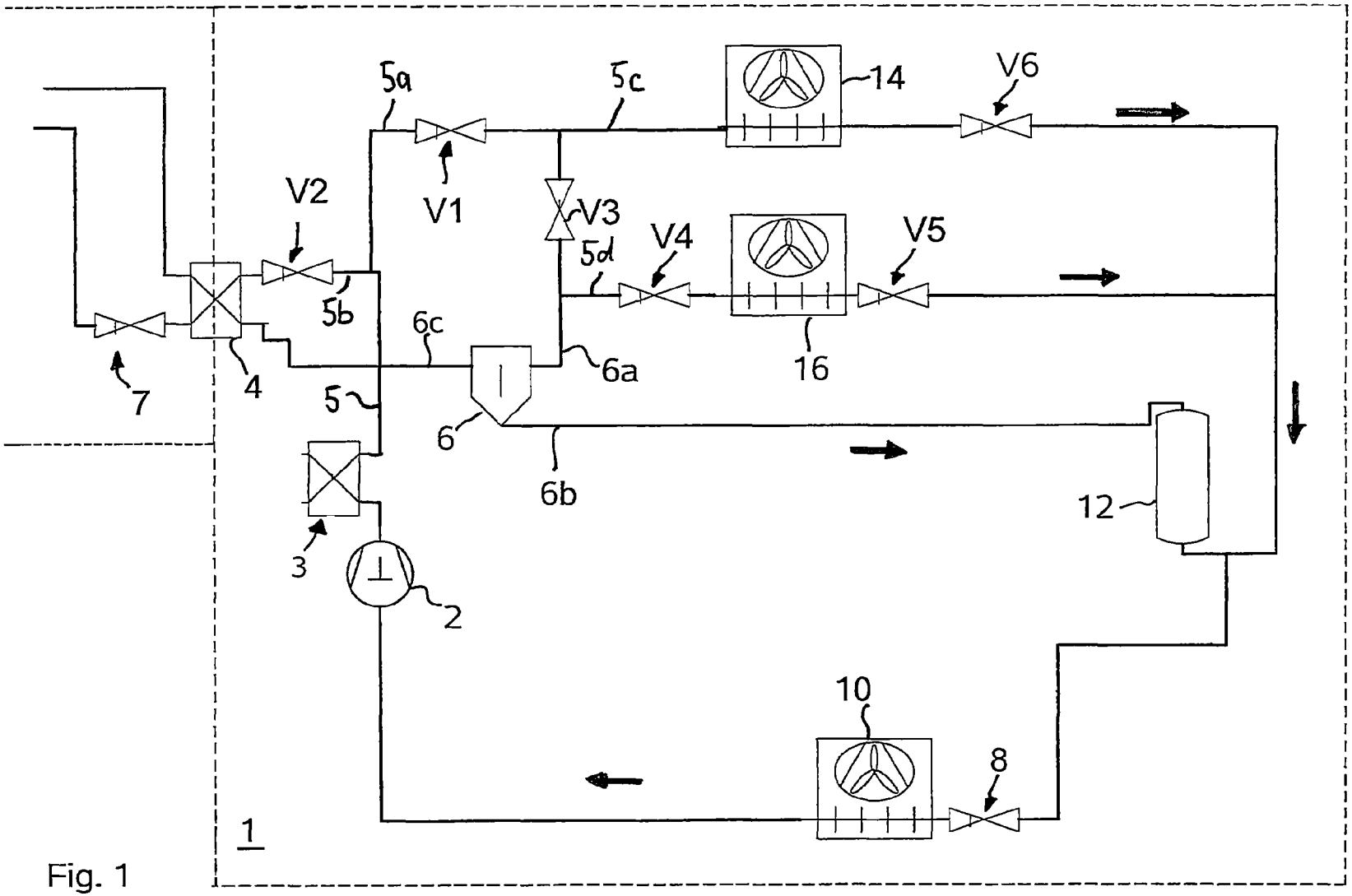
FIG. 1 shows a schematic view of an exemplary refrigeration circuit according to an embodiment of the invention.

The refrigeration circuit 1 is depicted in the middle and right-hand side of Fig. inside the box surrounded by a dashed line. On the left-hand side of Fig., part of a heat-pump system 7 is shown, in particular a heat source/evaporator, the lines connecting to the heat source/evaporator and a valve arranged in such lines.

The heat source/evaporator of the heat-pump system 7 forms the heat rejecting heat exchanger 4 of the refrigeration circuit 1, and the refrigeration circuit 1 is efficiently coupled to the separate heat pump system 7 in that way, since the heat generated by the heat rejecting heat exchanger 4 is not wasted, but rather utilized by the heat pump system 7, for example for providing heated water or warming parts of a building.

The refrigeration circuit 1 comprises, in flow direction of a refrigerant as indicated by arrows, a compressor 2 for compressing the refrigerant to a relatively high pressure, a pressure line 5 connected to the output of the compressor 2 and an optional heat exchanger 3 cooling the hot, high pressure refrigerant against a secondary medium, such as the refrigerant flowing in the heat pump system 7, After the optional heat exchanger 3, the pressure line branches into a first pressure line portion 5*a* leading to conventional air-cooled condensers 14 and 16 and into a second pressure line portion 5*b* leading to a heat rejecting heat exchanger 4 that exchanges heat against the heat source/evaporator of the heat pump system 7.

By means of a valve V2 arranged in the second pressure line portion 5*b* the second pressure line portion 5*b* can be opened and closed and likewise the first pressure line portion 5*a* can be opened and closed by means of a valve V1 arranged in the first pressure line portion 5*a*, as will be explained in detail below.

The first pressure line portion 5*a*, after the valve V1 branches into a first line portion 5*c* for the first air-cooled condenser 14 and into a second line portion 5*d* for the second air-cooled condenser 16. The two condensers 14, 16 are therefore connected in parallel, and in the present non-limiting embodiment, they differ in their maximum achievable condensing power. In particular, the air-cooled condenser 14 in the first line portion 5*c* has a higher condensing power, and the air-cooled condenser 16 in the second line portion 5*d* has a lower condensing power. After the condensers 14, 16 the parallel line portions 5*c* and 5*d* join again. The air-cooled condensers 14, 16 are connected with their outputs to an expansion device 8 and to an evaporator 10. After having been condensed in at least one of the condensers 14, 16, the liquid refrigerant flows to the expansion device 8 and the evaporator 10 where the refrigerant is evaporated and the environment of the evaporator 10, for e.g. a refrigerating sales furniture or an air conditioning system, is cooled. The evaporated refrigerant leaving the evaporator 10 is supplied to the compressor 2 via a suction line, thereby closing the refrigerant circuit.

The second pressure line portion 5*b* connects to the heat rejecting heat exchanger 4, and after passage through the heat rejecting heat exchanger 4 the refrigerant is delivered through a line 6*c* to a gas-liquid-separator 6, in which the refrigerant coming from the heat rejecting heat exchanger 4 is separated into a gaseous phase refrigerant portion and a liquid phase refrigerant portion, and in which the gaseous phase refrigerant portion is output via a gaseous phase output to the line 6*a* and the liquid phase refrigerant portion is output via a liquid phase output to the line 6*b*.

Line 6*a* connects to and branches into the first line portion 5*c* for the first air-cooled condenser 14 and the second line portion 5*d* for the second air-cooled condenser 16.

Line 6*b* connects the liquid phase output of the gas-liquid-separator 6 to a collecting container/receiver 12, particularly to a top portion thereof, where the liquid phase refrigerant collects. The collecting container 12, particularly a bottom portion thereof, is connected to an expansion device 8 and to an evaporator 10 evaporating the refrigerant and cooling the environment of the evaporator 10, for e.g. a refrigerating sales furniture or an air conditioning system. The evaporated refrigerant leaving the evaporator 10 is supplied to the compressor 2 via a suction line, thereby closing the refrigerant circuit.

The ratio between the liquid phase and the gaseous phase portions of the refrigerant leaving the heat rejecting heat exchanger 4 depends on the amount of heat that is needed/dissipated by the heat pump system 7. In particular, if the heat dissipated by the heat pump system 7 is less than the condensing power needed by the refrigerating system only a portion of the refrigerant is condensed. On the other hand, it is possible that the heat pump system 7 will absorb all the heat from the refrigerant and all the refrigerant will be condensed. In this case only liquid refrigerant will leave the heat rejecting heat exchanger 4.

A number of exemplary valves V1 to V6 are arranged in the refrigerant conduits of the refrigeration circuit 1 in order to allow to adjust to different operation conditions.

A first valve V1 is arranged between behind the point where the pressure line 5 branches into the first and the second pressure line portions 5*a* and 5*b* and the point where the first pressure line portion 5 branches into the first and the second line portions 5*c* and 5*d*, particularly in the first pressure line portion 5*a* leading to the condenser(s) 14, 16.

A second valve V2 is arranged behind the point where the pressure line 5 branches into the first and the second pressure line portions 5*a* and 5*b* and before the inlet side of the heat rejecting heat exchanger 4, particularly in the second pressure line portion 5*b* leading to the heat rejecting heat exchanger 5*b*.

A third valve V3 is arranged in the line portion before the condensers 14 and 16 which line portion connects the condensers 14 and 16 in parallel.

A sixth valve V6 is arranged in the line portion behind the condensers 14 and 16 which line portion connects the condensers 14 and 16 in parallel.

A fourth valve V4 and a fifth valve V5 are arranged in the line portion 5*d* before and behind the condenser 16.

All monitoring and switching steps as described herein can be carried out by an appropriate control unit and appropriate sensors.

In particular, the condensing power needed in order to provide the desired cooling at the evaporator 10 can be determined based on the temperature measured and desired at the evaporator 10.

In a first mode of operation no condensing power at all is supplied by the heat pump system 7, e.g. because the heat pump system 7 is deactivated. In this case it does not make any sense to flow the refrigerant through the heat rejecting heat exchanger 4 and the gas-liquid-separator 6, as no heat rejection is provided by the heat rejecting heat exchanger 4. Therefore, valve V2 is closed and valve V1 is opened in order to supply the refrigerant leaving the compressor 2 directly to the inlet side of the condensers 14 and 16.

If only little condensing power is needed, the air-cooled condenser 14 with the higher condensing power is disconnected by closing the valve V6 and an optional additional valve provided in the first pressure line portion 5*c* before the air-cooled condenser 14, and the whole refrigerant is guided through the air-cooled condenser 16 with the lower condensing power by opening the valves V3, V4 and V5.

If more condensing power is needed, the air-cooled condenser 16 with the lower condensing power is disconnected by closing the valves V3, V4 and V5, and the whole refrigerant is guided through the air-cooled condenser 14 with the higher condensing power by opening the valve V6 and an optional additional valve provided in the first pressure line portion 5*c* before the air-cooled condenser 14.

If much or maximum condensing power is needed, both air-cooled condensers 14 and 16 are connected by opening the valves V3, V4, V5 and V6, and an optional additional valve provided in the first pressure line portion 5*c* before the air-cooled condenser 14.

By such first mode of operation without condensing support of the heat pump system 7, the condensing power delivered in the refrigeration circuit can efficiently be matched to condensing power needed.

In a second mode of operation, condensing power is delivered by the heat pump system 7, which is running, and therefore valve V2 is opened and valve V1 is closed.

In a first situation of the second mode of operation, the condensing power delivered by the heat pump system 7 or in other words the heat dissipated by the heat pump system 7 is equal to or larger than the condensing power needed, then all the refrigerant flowing through the heat rejecting heat exchanger 4 is liquefied, and no gaseous phase portion of the refrigerant remains that needs to be separated by the liquid-gas-separator 6. In this case, valves V3 to V6 are closed or switched to a closed state. Thus, the liquid refrigerant leaving the heat rejecting heat exchanger 4 leaves the gas-liquid-separator 6 via the liquid phase output and flows to the collecting container 12, to the expansion device 8 and the evaporator 10.

In a second situation of the second mode of operation, in which the condensing power needed by the refrigeration circuit 1 slightly exceeds the cooling power provided by the heat pump system 7, the refrigerant leaving the heat rejecting heat exchanger 4 comprises a small gaseous phase portion, which is separated from the liquid phase portion by the gas-liquid-separator 6. In this mode of operation, in addition to valve V2, valves V4 and V5 are opened so that the air-cooled condenser 16 with the lower condensing power is activated. The gas phase portion of the refrigerant leaving the heat rejecting heat exchanger 4 is separated in the gas-liquid-separator 6 and flows via opened valve V4 into the air-cooled condenser 16 with the lower condensing power, where it is liquefied. The refrigerant liquefied in the second condenser 16 flows via the opened valve V6, mixes with liquid refrigerant from the refrigerant collector 12 and flows to the expansion device 8 and the evaporator 10.

Thus, in the second situation of the second mode the operation, the second condenser 16 ensures that the gas phase of the refrigerant leaving the heat rejecting heat exchanger 4 is liquefied and only liquid refrigerant is delivered to the expansion device 8, thereby enhancing the efficiency of the refrigeration circuit 1.

In a third situation of the second mode of operation, the condensing power needed by the refrigeration circuit 1 exceeds the cooling power delivered by the heat pump system 7 by a larger amount than in the second mode. Thus, the refrigerant leaving the heat rejecting heat exchanger 4 comprises a bigger portion of gaseous refrigerant than in the second situation. In this situation, valves V4 and V5 are closed, but valves V3 and V6 are opened such that the air-cooled condenser 14 with a larger condensing power is activated. In this third situation the refrigeration system works similar to the second situation with the only difference that the first condenser 14 having a higher condensing power than the second condenser 16 is used for liquefying the gaseous portion of the refrigerant leaving the heat rejecting heat exchanger 4.

By selectively activating the condenser 14 (third mode) and the condenser 16 (second mode) having different condensing power, the condenser 14, 16 having the optimal condensing power/capacity for efficiently condensing the gaseous portion of the refrigerant leaving the heat rejecting heat exchanger 4 is used for optimizing the performance and the efficiency of the refrigeration circuit 1.

The capacity of the first condenser 14 may e.g. be twice as large as the capacity of the second condenser 16.

Of course, additional condensers connected to the refrigeration circuit 1 by additional valves may be added to allow an even finer adjustment of the condensing capacity provided by the condensers 14, 16.

In a fourth situation of the second mode of operation, the condensing power needed by the refrigeration circuit 1 exceeds the cooling power delivered by the heat pump system 7 even more than in the third situation so that the condensing power/capacity of the first condenser 14 alone is not sufficient to condense the entire gaseous phase portion of the refrigerant leaving the heat rejecting heat exchanger 4.

In this case, all the valves V3 to V6 are opened in order to activate both condensers 14, 16 in parallel. Thus, the system may use the combined capacity of both condensers 14, 16 in order to liquefy all the gaseous phase portion of the refrigerant leaving the heat rejecting heat exchanger 4.

The valves V5 and V6 connected to the outlet sides of the condensers 14, 16 are closed if the respective condenser 14, 16 is not operating in order to avoid that liquid refrigerant from the collecting container 12 flows back into the non-operating condenser 14, 16 and collects there. Thus the amount of refrigerant circulating within the refrigeration circuit 1 can be reduced.

Thus, in a refrigerant circuit according to an exemplary embodiment only liquid refrigerant is delivered to the expansion device 8, which increases the efficiency of the refrigeration circuit 1 and enhances its reliability.

The condensers 14, 16 may be integrated in a single device having two (or more) condensing circuits, which may have different capacities.

Figure 2:
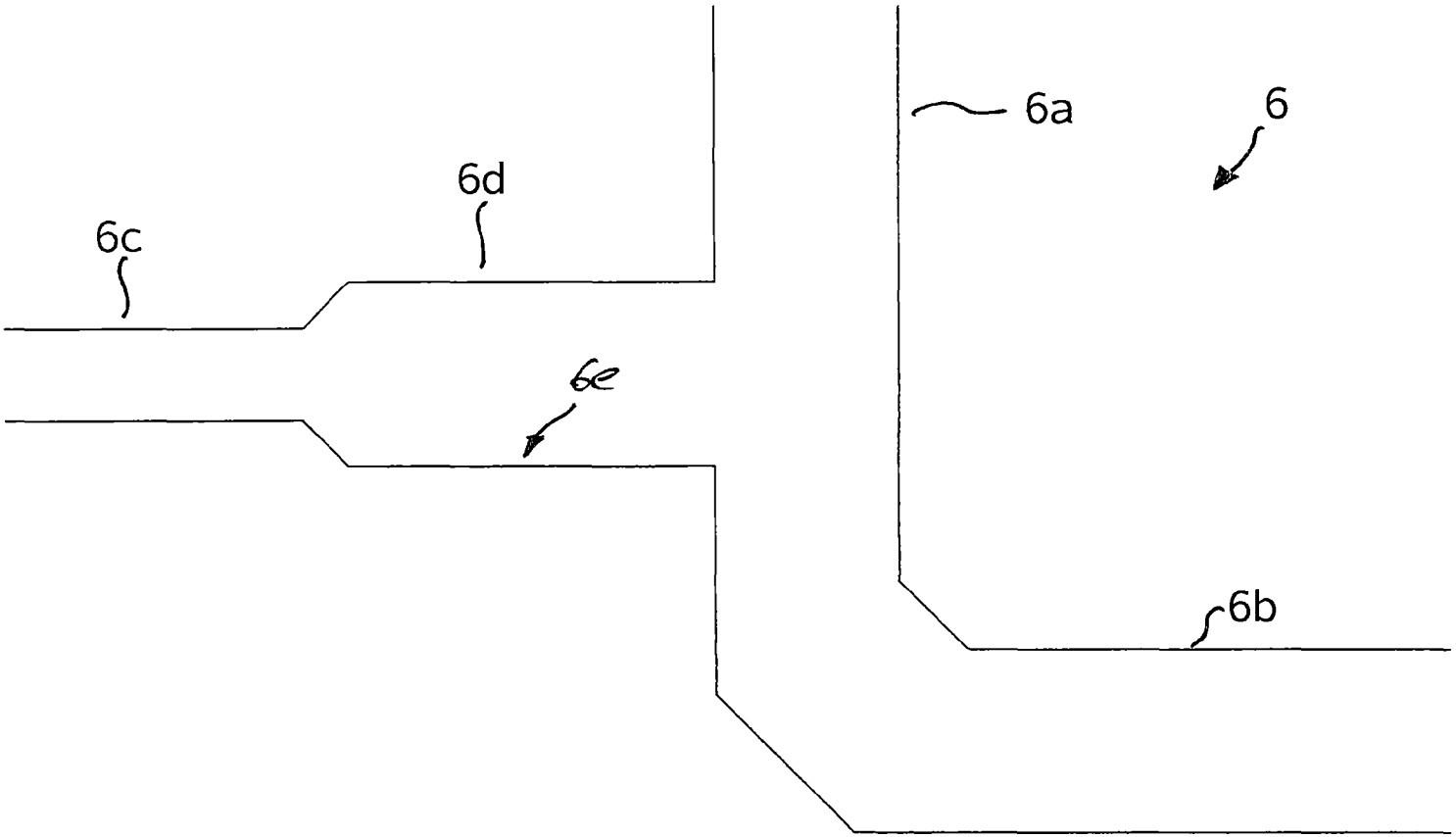
FIG. 2 shows a schematic view of an exemplary gas-liquid-separator according to an embodiment the invention, which gas-liquid-separator may be used in a refrigeration circuit of FIG. 1.

FIG. 2 shows a schematic view of an exemplary gas-liquid-separator 6 according to an embodiment of the invention, which gas-liquid-separator 6 may be used at the position 6 of the refrigeration circuit 1 of FIG. 1.

However, the gas-liquid-separator 6 is neither limited to the refrigeration circuit 1 of FIG. 1 nor to the position 6 in the line 6*c*, 6*b* of the refrigeration circuit 1 of FIG. 1. It rather can be provided in any refrigeration circuit where a gas-liquid mixture of a refrigerant is to be separated into a gaseous portion and a liquid portion.

In the embodiment shown in FIG. 2, the gas-liquid-separator 6 comprises an inlet pipe 6*c* with a first diameter, which is connected to or forms a line in which a refrigerant comprising a gaseous phase and a liquid phase flows. In FIG. 1 the inlet pipe 6*c* is connected to a line coming from the outlet side of the heat rejecting heat exchanger 4 delivering a gas-liquid-mixture of refrigerant.

A broadened line portion 6*d* connects to the inlet pipe 6*c*, which broadened line portion 6*d* is arranged downstream of the inlet pipe 6*c* and has a larger diameter than the inlet pipe 6*c*, which results in a reduction of the velocity of the refrigerant flow entering the broadened line portion 6*d*. Due to this reduction of flow-velocity the liquid phase portion of the refrigerant will collect in the area near to the wall of the broadened line portion 6*d* and in particular at the bottom 6*e* of the broadened line portion 6*d*, and the gaseous phase portion of the refrigerant flows above the liquid phase refrigerant.

At its downstream end opposite to the inlet pipe 6*c*, a T-branch connects to the broadened line portion 6*d* with the first branch 6*a* to be connected to a gaseous refrigerant output line 6*a* extending in an upwards direction and with the second branch 6*b* to be connected to a liquid refrigerant output line 6*b* extending in a downwards direction. The branches of the T-branch are arranged basically rectangularly to the line portions 6*c* and 6*d*.

The upwardly extending branch forms the gaseous refrigerant outlet, as the gaseous phase portion of the refrigerant entering the gas refrigerant separator 6 will leave the gas-liquid-separator 6 via said gaseous refrigerant outlet.

The downwardly extending branch forms the liquid refrigerant outlet, as the liquid phase portion of the refrigerant entering the gas refrigerant separator 6 and having collected at the bottom 6*e* of the broadened line portion 6*d* will leave the gas-liquid-separator 6 via said liquid refrigerant outlet.

The gaseous and liquid refrigerant outlets basically have the same large diameter as the broadened line portion 6*d*.

The gaseous refrigerant outlet connects to a gaseous refrigerant line, in FIG. 1 to the line 6*a* leading to the condenser(s) 14, 16, and likewise the liquid refrigerant outlet connects to a liquid refrigerant line, in FIG. 1 to the line 6*b* leading to the collecting container 12.

The line 6*b* leading to the collecting container 12 makes a bend to the right in FIG. 2, which bend however is optional.

The embodiment shown in FIG. 2 provides a gas-liquid-separator 6 which is easy to produce at low costs and provides a sufficient gas-liquid-separation for many applications and particularly for the refrigerant circuit according to an exemplary embodiment and more particularly for the refrigerant circuit as described with respect to FIG. 1.

The exemplary embodiment of the refrigeration circuit 1 of FIG. 1 depicts only one compressor 2, one expansion device 8 and one evaporator 10, respectively. The skilled person, however, will be aware that a plurality of compressors, expansion devices and evaporators may be provided without departing from the scope of the invention. The skilled person will also recognize that a deep-freezing circuit for providing even lower (deep-freezing) temperatures may be combined with the refrigeration circuit 1 shown in FIG. 1, as it is known in the state of the art.

Similarly, additional heat rejecting heat exchangers may be arranged parallel or serially to the heat rejecting heat exchanger 4 in order to connect further heat absorbing systems or components to the refrigeration circuit 1. In particular, an additional heat exchanger may be used in order to provide warm water without the use of a heat pump by flowing the water to be heated through said additional heat exchanger.

In a refrigeration circuit according to an exemplary embodiment the liquid portion of the refrigerant leaving the heat rejecting heat exchanger can be delivered directly to the expansion device while the gas portion of the refrigerant leaving the heat rejecting heat exchanger can be separated from said liquid portion and condensed in an additional condenser before being delivered to the expansion device.

Thus, only liquid refrigerant is supplied to the expansion device, increasing the efficiency of the refrigeration circuit and securing its operability under all environmental circumstances.

In a refrigeration circuit according to exemplary embodiments as described herein no liquid refrigerant is delivered to the condenser(s) so that an undesirable collection of liquid refrigerant which would increase the amount of refrigerant needed for operating the refrigeration circuit can be avoided.

Exemplary embodiments of the refrigeration circuit as described herein therefore provide a refrigeration circuit which may be operated securely and with high efficiency under all environmental circumstances and which in particular can be adjusted to different heat dissipation rates of the heat rejecting heat exchanger.

The collecting container can be arranged upstream of the expansion device and is configured for collecting refrigerant within the refrigeration circuit. Such collecting container forms a buffer of refrigerant and allows for adjusting the amount of refrigerant circulating within the refrigeration circuit according to the actual operating conditions.

According to exemplary embodiments of the refrigeration circuit as described herein, the gaseous portion of the refrigerant is reliably condensed/liquified before delivering the refrigerant to the expansion device which enhances the performance and efficiency of the refrigeration circuit and ensures that sufficient refrigeration performance is provided under all environmental circumstances.

The refrigeration circuit according to exemplary embodiments as described herein, being coupled to a heat pump system is efficient, since the heat generated by the condenser is not wasted, but rather utilized by the heat pump system. The heat dissipated by the heat rejecting heat exchanger is always matched to the heat needed to operate the refrigeration circuit at good operating conditions in order to obtain the desired cooling at the evaporators.

By the refrigeration circuit according to exemplary embodiments as described herein, an integrated condenser control commercial refrigeration to heat pump evaporator is provided. Heat needed can be provided by a heat pump system, in which the evaporator of the heating system is the condenser of the refrigeration circuit. Dependent on the amount of heat requested/needed, one or more valves can be controlled thus not allowing the heat dissipation to exceed the needs in this circuit. If cooling power delivered by heat pump system is less than condensing power needed by refrigeration system, only part of the refrigerant is condensed. To provide the additional condensing power needed and to condense the remaining part of the refrigerant, additional conventional air-cooled condensers are used. Thus, full condensation of refrigerant is achieved. By use of different valves, the refrigeration circuit according to exemplary embodiments as described herein, provides controls for using all, i.e. maximum, cooling power of the heating system and only remaining cooling power needed of the conventional refrigeration system. Use of conventional air-cooled condensers having different power to adopt needs of system best is possible. The refrigeration circuit according to exemplary embodiments as described herein is energy saving and can always be run at the same operating point thus making the system safer and more efficient.

According to one embodiment of the refrigeration circuit, the pressure line of the compressor branches into a first pressure line portion leading to the condenser(s) and into a second pressure line portion leading to the heat rejecting heat exchanger, a valve is arranged in the first pressure line portion being configured to open and close the first pressure line portion, and a further valve arranged in the second pressure line portion being configured to open and close the second pressure line portion. By such embodiment, the compressed refrigerant can selectively be led to the heat-rejecting heat exchanger or to the air-cooled condensers. Such control operation can be carried out by an appropriate control unit of the refrigeration circuit.

According to further embodiments of the refrigeration circuit, the valve in the first pressure line portion is configured to be closed when cooling power is available at the heat rejecting heat exchanger and to be opened when no cooling power is available at the heat rejecting heat exchanger, and/or the valve in the second pressure line portion is configured to be opened when cooling power is available at the heat rejecting heat exchanger and to be closed when no cooling power is available at the heat rejecting heat exchanger. By such embodiments, the compressed refrigerant can selectively be led to the heat-rejecting heat exchanger or to the air-cooled condenser(s), depending on the availability of condensing power at the heat rejecting heat exchanger. Such control operation can be carried out by an appropriate control unit of the refrigeration circuit.

According to a further embodiment of the refrigeration circuit, at least two condensers are provided being connected in parallel, wherein the first pressure line portion branches into separate line portions for each of the condensers. By the provision of two or more condensers, the condensing capacity can be adjusted to the needs of the refrigeration circuit in order to provide a high efficiency.

According to a further embodiment of the refrigeration circuit, the at least two condensers being connected in parallel differ in their maximum achievable condensing power. By the provision of two or more condensers having different condensing power/capacities, the condensing capacity can be adjusted even more precisely to the needs of the refrigeration circuit in order to provide high efficiency.

According to a further embodiment of the refrigeration circuit, a gas-liquid-separator is provided being arranged in the line connecting the output of the heat rejecting heat exchanger to the collecting container, the gas-liquid-separator separating the refrigerant coming from the heat rejecting heat exchanger into a gaseous phase refrigerant portion and liquid phase refrigerant portion and having a gaseous phase output and a liquid phase output. By the provision of such gas-liquid-separator the partially condensed refrigerant leaving the heat rejecting heat exchanger and forming a mixture of gaseous phase and liquid phase refrigerant can reliably separated, and the gaseous phase refrigerant and liquid phase refrigerant can be treated differently in order to provide high efficiency.

According to a further embodiment of the refrigeration circuit, the gaseous phase output of the gas-liquid-separator is selectively connected or connectable to at least one of the two condensers, and/or wherein the liquid phase output of the gas-liquid-separator is connected to the collecting container. Thereby it is ensured that the gaseous phase refrigerant is reliably condensed in the condensers, while the liquid phase refrigerant will flow over the collecting container to the expansion device and the evaporator, which further improves the efficiency. Such control operation can be carried out by an appropriate control unit of the refrigeration circuit.

According to a further embodiment of the refrigeration circuit, valves are provided for selectively connecting the first pressure line portion or the liquid phase output of the gas-liquid-separator to at least one of the condensers. Such valves can be controlled or switched by an appropriate control unit of the refrigeration circuit. By such valves, the refrigeration circuit can be controlled to run in an operation mode in which the heat rejecting heat exchanger is not running and the pressurized refrigerant is led to the condensers where it is condensed or in an operation mode in which the pressurized refrigerant has been condensed partially in the heat rejecting heat exchanger, the pressurized refrigerant has been separated in the gas-liquid-separator into its gaseous phase and liquid phase portions and the gaseous phase portion of the refrigerant is reliably condensed in the condenser(s).

According to a further embodiment of the refrigeration circuit, the refrigeration circuit is configured to determine the condensing power needed in order to provide the desired cooling at the evaporator. This condensing power needed is used as a command variable for to controlling the refrigeration circuit.

According to a further embodiment of the refrigeration circuit, the refrigeration circuit is configured to measure the condensing power delivered by the heat rejecting heat exchanger. For doing this an appropriate sensor at the heat rejecting heat exchanger and/or an appropriate control unit can be provided.

According to a further embodiment of the refrigeration circuit, the refrigeration circuit is configured to compare the condensing power needed to the condensing power available through the heat rejecting heat exchanger and the condenser (s). For determining such available condensing power the specifications of the heat rejecting heat exchanger and the condenser(s), appropriate sensors at the heat rejecting heat exchanger and/or the condenser(s) can be used. The comparison can be carried out in an appropriate control unit of the refrigeration circuit.

According to a further embodiment of the refrigeration circuit, the refrigeration circuit is configured, in the state when no cooling power is available at the heat rejecting heat exchanger, the valve in the first pressure line portion is opened and the valve in the second pressure line portion is closed, to connect the first pressure line portion to those condenser(s) that are needed to deliver the condensing power needed. Such control operation can be carried out by an appropriate control unit of the refrigeration circuit. By such embodiment the heat rejecting heat exchanger can reliably be disconnected from the compressor, in case no cooling power is available there, and the condenser(s) can be connected to the compressor in order to provide the necessary condensing power.

According to a further embodiment of the refrigeration circuit, in the state when no cooling power is available at the heat rejecting heat exchanger, when the valve in the first pressure line portion is opened and when the valve in the second pressure line portion is closed, the refrigeration circuit is configured to connect, by means of valves, the first pressure line portion to a condenser providing a lower condensing power in case only little condensing power is needed, the first pressure line portion to a condenser providing a higher condensing power in case more condensing power is needed, and the first pressure line portion to all condensers in case very much or maximum condensing power is needed. Such control operation can be carried out by an appropriate control unit of the refrigeration circuit. By such embodiment, the condensers can individually be controlled such that the condensing power delivered perfectly matches with the condensing power needed, which allows to run the refrigeration circuit at an efficient operating point.

According to a further embodiment of the refrigeration circuit, in the state when cooling power is available at the heat rejecting heat exchanger, when the valve in the second pressure line portion is opened and when the valve in the first pressure line portion is closed, the refrigeration circuit is configured to compare the condensing power needed to the condensing power delivered by the heat rejecting heat exchanger in order to obtain the additional condensing power needed to be delivered by the condenser(s). Such additional condensing power needed is a command variable for controlling the condensers.

According to a further embodiment of the refrigeration circuit, in the state when cooling power is available at the heat rejecting heat exchanger, when the valve in the second pressure line portion is opened and when the valve in the first pressure line portion is closed, the refrigeration circuit is configured to connect the gaseous phase output of the gas-liquid-separator to those condenser(s) that are needed to deliver the additional condensing power needed. Such control operation can be carried out by an appropriate control unit of the refrigeration circuit.

According to a further embodiment of the refrigeration circuit, in the state when cooling power is available at the heat rejecting heat exchanger, when the valve in the second pressure line portion is opened and when the valve in the first pressure line portion is closed, the refrigeration circuit is configured to connect, by means of valves, the gaseous phase output of the gas-liquid-separator to a condenser providing a lower condensing power in case only little additional condensing power is needed, the gaseous phase output of the gas-liquid-separator to a condenser providing a higher condensing power in case more additional condensing power is needed, and the gaseous phase output of the gas-liquid-separator to all condensers in case very much or maximum additional condensing power is needed. Such control operation can be carried out by an appropriate control unit of the refrigeration circuit.

According to a further embodiment of the refrigeration circuit, in the state when cooling power is available at the heat rejecting heat exchanger, when the valve in the second pressure line portion is opened and when the valve in the first pressure line portion is closed, the refrigeration circuit is configured such that the gaseous phase output of the gas-liquid-separator is disconnected, by means of valves, from any of the condensers, in case no additional condensing power is needed. Such control operation can be carried out by an appropriate control unit of the refrigeration circuit.

By such embodiments, the condensers can individually be controlled such that the condensing power delivered both by the heat rejecting heat exchanger and the condensers perfectly matches with the condensing power needed, which allows to run the refrigeration circuit at an efficient operating point.

The gas-liquid-separator according to exemplary embodiments as described herein can be manufactured at low costs and provides a high separating efficiency. It can be used in the refrigeration circuit as described above. However, the gas-liquid-separator is neither limited to the refrigeration circuit as described above nor to the position in the line of the refrigeration circuit as described above. It rather can be provided in any refrigeration circuit where a gas-liquid mixture of a refrigerant is to be separated into a gaseous portion and a liquid portion.

According to an embodiment of the gas liquid-separator according to exemplary embodiments as described herein, the first branch of the T-branch to be connected to a gaseous refrigerant output line extends in an upwards direction and the second branch of the T-branch to be connected to a liquid refrigerant output line extends in a downwards direction. This provides for a particularly good separation of the gaseous phase refrigerant which flows into the upwardly extending gaseous refrigerant output line and the liquid phase refrigerant which flows into the downwardly extending liquid refrigerant output line.

The heating and cooling system according to exemplary embodiments as described herein allows to operate a combination of a refrigeration circuit and a heat pump system coupled to each other by means of a heat rejecting heat exchanger refrigeration circuit that forms at the same time an evaporator of the heat pump system with maximum efficiency.

While the invention has been described with reference to exemplary embodiments, it will be understood by those skilled in the art that various changes may be made and equivalence my be substitute for elements thereof without departing from the scope of the invention. In addition, modifications may be made to adapt a particular situation or material to the teachings of the invention without departing from the essential scope thereof. Therefore, it is intended that the invention is not limited to the particular embodiments disclosed, but that the invention will include all embodiments falling within the scope of the pendent claims.

REFERENCE SIGNS

1 refrigeration circuit
2 compressor
4 heat rejecting heat exchanger
5 pressure line
5*a* first pressure line portion
5*b* second pressure line portion
5*c* first line portion
5*d* second line portion
6 separation device
6*a* gaseous refrigerant output line
6*b* liquid refrigerant output line
6*c* inlet pipe
6*d* broadened line portion
6*e* bottom of the broadened line portion
7 heat pump system
8 expansion device
10 evaporator
12 collecting container
14 first condenser
16 second condenser
V2, V1, V3, V4, V5, V6 switchable valves

The invention claimed is:

1. A refrigeration circuit for circulating a refrigerant and comprising in the direction of flow of the refrigerant:
- a compressor;
- at least one condenser for rejecting heat to ambient air;
- an expansion device; and
- an evaporator;
- the refrigeration circuit further comprising
- a collecting container, the output of which being connected to the expansion device;
- a heat rejecting heat exchanger for heat exchange of the refrigerant to a heat pump system, the output of the heat rejecting heat exchanger being connected to the collecting container and
- at least one valve connecting the heat rejecting heat exchanger or the at least one condenser to the output of the compressor depending on the availability of cooling power at the heat rejecting heat exchanger; and
- a gas-liquid-separator arranged in a line connecting an output of the heat rejecting heat exchanger to the collecting container, the gas-liquid-separator separating the refrigerant coming from the heat rejecting heat exchanger into a gaseous phase refrigerant portion and liquid phase refrigerant portion and having a gaseous phase output and a liquid phase output.

2. The refrigeration circuit of claim 1, the pressure line of the compressor branching into a first pressure line portion leading to the at least one condenser and into a second pressure line portion leading to the heat rejecting heat exchanger, further comprising a valve arranged in the first pressure line portion being configured to open and close the first pressure line portion and a valve arranged in the second pressure line portion being configured to open and close the second pressure line portion.

3. The refrigeration circuit of claim 2, wherein the valve in the first pressure line portion is configured to be closed when cooling power is available at the heat rejecting heat exchanger and to be opened when no cooling power is available at the heat rejecting heat exchanger.

4. The refrigeration circuit of claim 2, wherein the valve in the second pressure line portion is configured to be opened when cooling power is available at the heat rejecting heat exchanger and to be closed when no cooling power is available at the heat rejecting heat exchanger.

5. The refrigeration circuit of claim 2, wherein at least two condensers are provided being connected in parallel, wherein the first pressure line portion branches into separate line portions for each of the condenser.

6. The refrigeration circuit of claim 5, wherein the at least two condensers being connected in parallel differ in their maximum achievable condensing power.

7. The refrigeration circuit of claim 1, wherein the gas-liquid-separator is provided in the line connecting the output of the heat rejecting heat exchanger to the collecting container, the gas-liquid-separator separating the refrigerant coming from the heat rejecting heat exchanger into a gaseous phase refrigerant portion and liquid phase refrigerant portion and having a gaseous phase output and a liquid phase output.

8. The refrigeration circuit of claim 7, wherein the gaseous phase output of the gas-liquid-separator is selectively connected to the at least one condenser, and/or wherein the liquid phase output of the gas-liquid-separator is connected to the collecting container.

9. The refrigeration circuit of claim 1, further comprising valves for selectively connecting the first pressure line portion or the liquid phase output of the gas-liquid-separator to the at least one condenser.

10. The refrigeration circuit of claim 1, wherein the refrigeration circuit is configured to determine the condensing power needed in order to provide the desired cooling at the evaporator.

11. The refrigeration circuit of claim 10, wherein the refrigeration circuit is configured to measure the condensing power delivered by the heat rejecting heat exchanger.

12. The refrigeration circuit of claim 10, wherein the refrigeration circuit is configured to compare the condensing power needed to the condensing power available through the heat rejecting heat exchanger and the at least one condenser.

13. The refrigeration circuit of claim 12, wherein the refrigeration circuit is configured, in the state when no cooling power is available at the heat rejecting heat exchanger, the valve in the first pressure line portion is opened and the valve in the second pressure line portion is closed, to connect the first pressure line portion to the at least one condenser needed to deliver the condensing power needed.

14. The refrigeration circuit of claim 13, wherein, in the state when no cooling power is available at the heat rejecting heat exchanger, when the valve in the first pressure line portion is opened and when the valve in the second pressure line portion is closed, the refrigeration circuit is configured to connect, by means of valves, the first pressure line portion to a first condenser providing a lower condensing power in case only little condensing power is needed, the first pressure line portion to a second condenser providing a higher condensing power in case more condensing power is needed, and the first pressure line portion to both condensers in case maximum condensing power is needed.

15. The refrigeration circuit of claim 10, wherein, in the state when cooling power is available at the heat rejecting heat exchanger, when the valve in the second pressure line portion is opened and when the valve in the first pressure line portion is closed, the refrigeration circuit is configured to compare the condensing power needed to the condensing power delivered by the heat rejecting heat exchanger in order to obtain the additional condensing power to be delivered by the at least one condenser.

16. The refrigeration circuit of claim 15, wherein, in the state when cooling power is available at the heat rejecting heat exchanger, when the valve in the second pressure line portion is opened and when the valve in the first pressure line portion is closed, the refrigeration circuit is configured to connect the gaseous phase output of the gas-liquid-separator to the at least one condenser needed to deliver the additional condensing power needed.

17. The refrigeration circuit of claim 16, wherein, in the state when cooling power is available at the heat rejecting heat exchanger, when the valve in the second pressure line portion is opened and when the valve in the first pressure line portion is closed, the refrigeration circuit is configured to connect, by means of valves, the gaseous phase output of the gas-liquid-separator to a first condenser providing a lower condensing power in case only little additional condensing power is needed, the gaseous phase output of the gas-liquid-separator to a second condenser providing a higher condensing power in case more additional condensing power is needed, and the gaseous phase output of the gas-liquid-separator to both condensers in case maximum additional condensing power is needed.

18. The refrigeration circuit of claim 17, wherein, in the state when cooling power is available at the heat rejecting heat exchanger, when the valve in the second pressure line portion is opened and when the valve in the first pressure line portion is closed, the refrigeration circuit is configured such that the gaseous phase output of the gas-liquid-separator is disconnected, by means of valves, from any of the condenser, in case no additional condensing power is needed.

19. A gas-liquid-separator, for use in a refrigeration circuit, the gas-liquid-separator connected to an inlet line in which refrigerant comprising a gaseous phase and a liquid phase flows, the gas-liquid-separator comprising:

a broadened line portion having a larger diameter than the inlet line and being connected to the inlet line extending in the same direction as the inlet line in which refrigerant comprising a gaseous phase and a liquid phase flows, wherein the velocity of flow of the refrigerant is reduced in the broadened line portion, such that the liquid phase refrigerant flows at the bottom and the gaseous phase refrigerant flows above the liquid phase refrigerant; and a T-branch, with the first branch to be connected to a gaseous refrigerant output line and the second branch to be connected to a liquid refrigerant output line, wherein the branches of the T-branch are arranged basically rectangularly to the inlet line and to the broadened line portion.

20. The gas-liquid-separator of claim 19, wherein the first branch of the T-branch to be connected to a gaseous refrigerant output line extends in an upwards direction and the second branch of the T-branch to be connected to a liquid refrigerant output line extends in a downwards direction.

21. A heating and cooling system comprising a refrigeration circuit according to claim 1; and a heat-pump system;

wherein the first heat rejecting heat exchanger of the refrigeration circuit is configured to serve as a heat source in the heat pump system.

22. The refrigeration circuit of claim 1, wherein the at least one valve comprises two valves.

* * * * *